US005894827A

United States Patent [19]

Kamura et al.

[11] Patent Number: 5,894,827

[45] Date of Patent: Apr. 20, 1999

[54] CONTROL DEVICE FOR INTERNAL-COMBUSTION ENGINE

[75] Inventors: Hitoshi Kamura; Kenjiro Hatayama, both of Kyoto; Atsuyoshi Kojima, Toyota; Hiroki Tamura, Hoi-gun, all of Japan

[73] Assignee: Mitsubishi Jidosha Kogyo Kabushiki Kaisha, Tokyo, Japan

[21] Appl. No.: 08/907,511

[22] Filed: Aug. 8, 1997

[30] Foreign Application Priority Data

Aug. 9, 1996 [JP] Japan ..... 8-210804
May 29, 1997 [JP] Japan ..... 9-139895

[51] Int. Cl.[6] ..... F02B 5/00

[52] U.S. Cl. ..... 123/305

[58] Field of Search ..... 123/305, 425

[56] References Cited

U.S. PATENT DOCUMENTS 5,715,794 2/1998 Nakamura et al. ..... 123/425
5,722,363 3/1998 Iida et al. ..... 123/305
5,735,241 4/1998 Matsuura ..... 123/305
5,738,074 4/1998 Nakamura et al. ..... 123/425

FOREIGN PATENT DOCUMENTS 4325742 11/1992 Japan .

*Primary Examiner*—Raymond A. Nelli

[57] ABSTRACT

When the rotation speed of an in-cylinder injection engine 1 reduces to a rotation speed for increasing the amount of air which has been set on a higher rotation speed side than a fuel supply-return rotation speed, the amount of air is increased. Thereafter, when the rotation speed of the in-cylinder injection engine 1 reduces to the fuel supply-return rotation speed, the supply of fuel is resumed in the fuel cut mode to securely prevent the rotation speed from lowering and to reduce a torque down during resumption of fuel-supply and deteriorated fuel consumption.

21 Claims, 6 Drawing Sheets

Idle
off-Idle
Fig.3 (b) Engine rotation speed Ne
d Ne/dt
Ne a
Return Ne
0
Fig.3 (c) Fuel supply stop
Fuel supply Amount of air
Much
Little
A
B
C
D
t

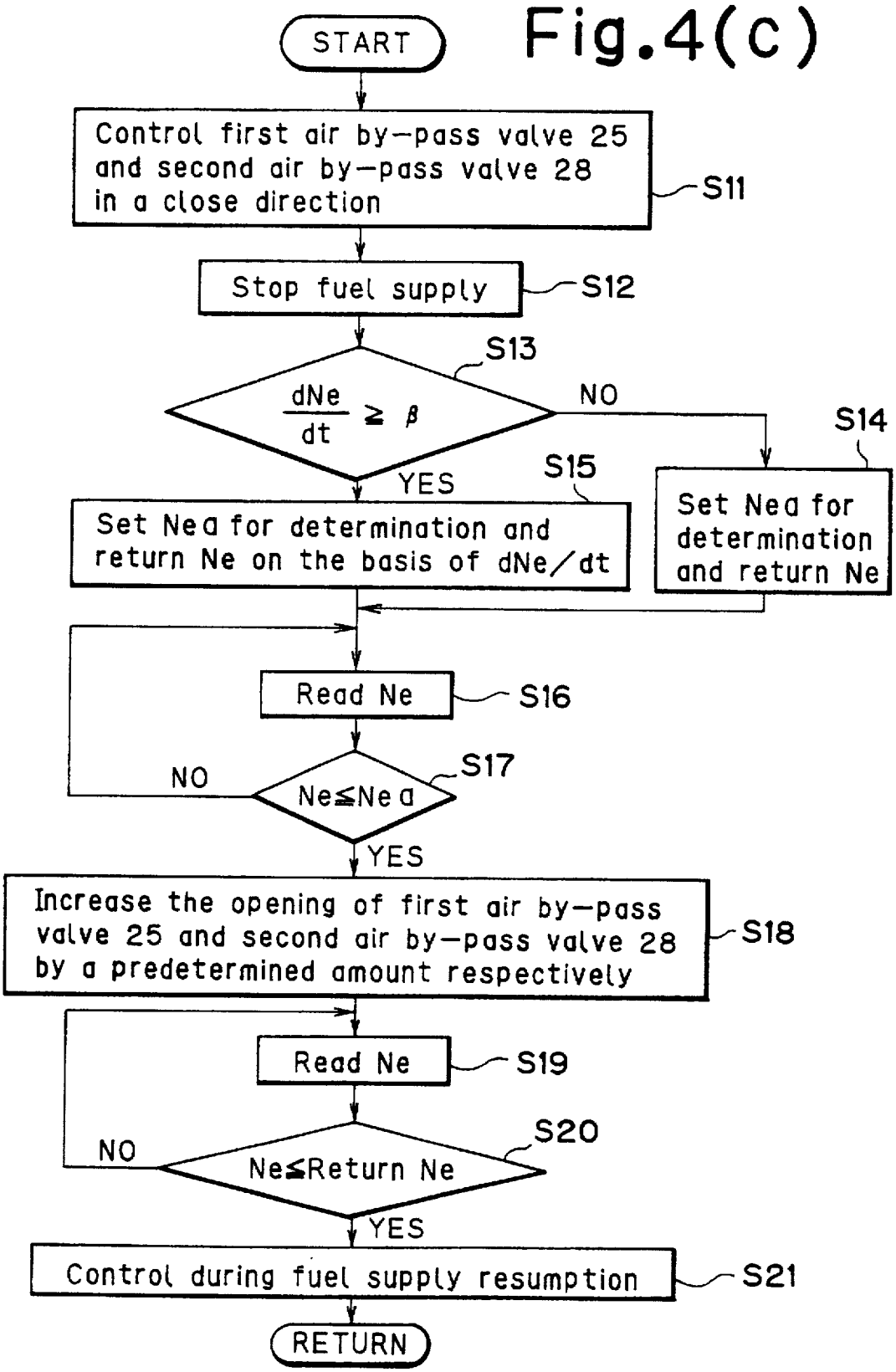
Fig.4(c)
START
Control first air by-pass valve 25 and second air by-pass valve 28 in a close direction
S11
Stop fuel supply
S12
S13
dNe/dt ≥ β
NO
YES
S14
S15
Set Ne a for determination and return Ne on the basis of dNe/dt
Set Ne a for determination and return Ne
Read Ne
S16
S17
NO
Ne≦Ne a
YES
Increase the opening of first air by-pass valve 25 and second air by-pass valve 28 by a predetermined amount respectively
S18
Read Ne
S19
S20
NO
Ne≦Return Ne
YES
Control during fuel supply resumption
S21
RETURN

CONTROL DEVICE FOR INTERNAL-COMBUSTION ENGINE

BACKGROUND OF THE INVENTION

The present invention relates to a control device for an internal-combustion engine mounted on an automobile or the like, and more particularly to a control device intended to reduce, in an in-cylinder injection internal-combustion engine for directly injecting fuel into a combustion chamber, torque down caused upon resuming supply of fuel in fuel cut mode.

In recent years, in order to improve fuel consumption by improving the fuel consumption rate, an internal-combustion engine (engine) capable of being operated at a leaner air-fuel ratio than the theoretical air-fuel ratio, i.e., lean air-fuel ratio has been developed and put into practical use.

Accordingly, in an engine operable at a lean air-fuel ratio, an air-fuel mixture within a combustion chamber is stratified by contriving the shapes of the combustion chamber and intake port and the fuel injection system, whereby an air-fuel mixture with high fuel concentration is gathered close to the ignition plug as possible to improve the ignitability. When it becomes thus possible to suitably stratify the air-fuel mixture, it becomes possible to make the entire air-fuel ratio lean by making only the fuel concentration of the air-fuel mixture near the ignition plug high, that is, to make it rich. Also, the air-fuel ratio can be freely controlled within a wide range.

On the other hand, in order to further improve the fuel consumption rate, a control (fuel cut mode) for stopping supply of fuel into the combustion chamber in an engine is effected when a decelerating state of a vehicle is detected from operating condition. In the fuel cut mode, since a sufficient feeling of deceleration cannot be obtained when there is a large amount of air, the amount of intake air is also reduced especially in case the engine is operated in a lean air-fuel ratio and the amount of intake air is increased and corrected to an amount of intake air required for the lean air-fuel ratio. When the vehicle decelerates and reduces the engine rotation speed to a predetermined rotation speed, supply of fuel is resumed for maintaining the engine idle operating condition.

In the fuel cut mode, which stops supply of fuel to the engine combustion chamber, torque down is prevented by somewhat increasing the fuel concentration of the air-fuel mixture when the engine rotation speed reduces to a predetermined rotation speed to resume supply of fuel. To increase the fuel concentration of the air-fuel mixture, however, there is a limit, and the torque down is not sufficiently prevented under the present conditions. Especially in an in-cylinder injection internal-combustion engine in which fuel injection is effected in the compression stroke, since too high air-fuel ratio may cause accidental fire, the fuel concentration of the air-fuel mixture cannot be made too high.

Also, to secure any amount of air on resuming supply of fuel, it is also conceived to suppress reduction in the amount of air in the fuel cut mode. When, however, the reduction in the amount of air is suppressed in the fuel cut mode, the pressure within the intake manifold becomes high, and there will be a large amount of air to cause defective deceleration (a feeling of free running).

Thus, as means for improving combustion stability on returning from the fuel cut mode, such one as described in, for example, Japanese Patent Laid-Open Application No. 4-325742 has been conventionally known. In the engine disclosed in the aforesaid official gazette, when the engine rotation number N exceeds a predetermined rotation speed N1 and an accelerator pedal switch is ON, the engine is determined to be in a decelerated state and the fuel cut is effected. When the engine rotation speed N becomes below the predetermined rotation speed N1 with the accelerator pedal switch in an ON state during the fuel cut, the throttle opening θ is made larger by a predetermined amount C to gradually open the throttle opening θ. Then, when the throttle opening θ exceeds a map value K for control during deceleration, fuel-supply is resumed at a stage where the throttle opening θ is fixed to the map value K, whereby accidental fire is prevented to secure the combustion stability.

When fuel-supply is effected after the opening of the throttle valve or the like is opened to a predetermined opening on returning from the fuel cut mode as described above, it becomes possible, for the time being, to prevent accidental fire and to secure the combustion stability. Under such control, however, merely the commencement of release of the throttle valve during fuel cut and start of fuel-supply is determined depending upon whether or not the engine rotation speed N exceeds the predetermined rotation speed N1, and the engine rotation speed during fuel-supply is not taken into consideration. Therefore, the engine rotation speed at which fuel is supplied on returning from the fuel cut does not become constant when a rate of change in the engine rotation speed is different. If the rate of change in the engine rotation speed is high, the throttle opening θ exceeds the map value K, and no fuel is supplied although the engine rotation speed N has greatly lowered to return to a specified amount of air, thus possibly causing torque down resulting in engine stall. Also, if the rate of change in the engine rotation speed N is low when a predetermined rotation speed N1 for determining the aforesaid fuel cut is set to be high in order to eliminate the aforesaid defect, there is a possibility that although it does not cause an engine stall but it is possible to cut the fuel, fuel-supply will be started to deteriorate the fuel consumption.

The present invention has been achieved in the light of the aforesaid conditions, and its object is to provide a control device for an internal-combustion engine capable of improving the fuel consumption while reducing torque down caused upon resuming supply of fuel in the fuel cut mode.

SUMMARY OF THE INVENTION

In order to achieve the aforesaid object, a control device for an internal-combustion engine comprises: a fuel injection device for supplying fuel to a combustion chamber of the internal-combustion engine; mode selection means including a fuel cut mode for stopping supply of fuel and an ordinary fuel control mode for supplying fuel, the mode selection means selecting either the fuel cut mode or the ordinary fuel control mode on the basis of an operating condition of the engine; fuel control means for controlling the fuel injection device on the basis of the mode selected by the mode selection means; intake air amount correction means for correcting an amount of intake air sucked into the combustion chamber; return rotation speed setting means for setting a first rotation speed for resuming fuel-supply upon returning from the fuel cut mode to the ordinary fuel control mode; increasing-start rotation speed setting means for setting a second rotation speed for starting increase and correction of the amount of intake air prior to resumption of fuel-supply upon returning from the fuel cut mode to the ordinary fuel control mode on the side of higher rotation speed than the first rotation speed; and rotation speed detection means for detecting the rotation speed of the internal-combustion engine, wherein the intake air amount correction means increases and corrects the amount of intake air when the rotation speed of the internal-combustion engine reduces to the second rotation speed, and the fuel control means resumes fuel-supply when the rotation speed of the internal-combustion engine reduces to the first rotation speed.

Accordingly, while supply of fuel to the combustion chamber is being stopped in the fuel cut mode, when the rotation speed of the internal-combustion engine reduces to the second predetermined rotation speed, the amount of air is increased by the intake air amount correction means, and thereafter, when the rotation speed of the internal-combustion engine reduces to the first predetermined rotation speed, fuel-supply is caused to resume and returned from the fuel cut mode by the control means. Thereby, the amount of air has been increased during fuel return for resuming fuel-supply, and since the fuel-supply is resumed at a predetermined rotation speed, the deteriorated fuel consumption is reduced while the rotation speed during fuel return from the fuel cut mode is being reduced.

First, the increasing-start rotation speed setting means is characterized in that the second rotation speed is set on the basis of a deceleration rate of the internal-combustion engine or a vehicle mounted with the internal-combustion engine.

Second, the deceleration rate of the internal-combustion engine is a rate of change in deceleration of the engine rotation speed, and the increasing-start rotation speed setting means sets the second rotation speed on the high-rotation speed side as the rate of change in deceleration becomes higher.

This advances time for increasing the amount of intake air to prevent the lowered rotation speed on resuming the fuel-supply in the fuel cut mode during rapid deceleration.

Third, the increasing-start rotation speed setting means is characterized in that when the rate of change in deceleration exceeds a predetermined rate of change, the increasing-start rotation speed setting means sets the second rotation speed on the high rotation speed side in proportion to the magnitude of the rate of change in deceleration.

Fourth, the return rotation speed setting means is characterized in that when the rate of change in deceleration exceeds the predetermined rate of change, the first rotation speed is set on the high rotation speed side in proportion to the magnitude of the rate of change in deceleration.

Fifth, the return rotation speed setting means is characterized in that the first rotation speed is set on the high rotation speed side as the rate of change in deceleration becomes higher, and that a rate of increase in the first rotation speed is set so as to be lower than that in the second rotation speed.

Sixth, the deceleration rate of the internal-combustion engine is a rate of change in deceleration of the engine rotation speed, and the increasing-start rotation speed setting means includes a first arithmetic map for storing the second rotation speed previously is set on the basis of the magnitude of the rate of change in deceleration, and determines the second rotation speed corresponding to the rate of change in deceleration from the first arithmetic map.

Seventh, the return rotation speed setting means is characterized in that it includes a second arithmetic map for storing the first rotation speed previously is set on the basis of the magnitude of the rate of change in deceleration, and determines the first rotation speed corresponding to the rate of change in deceleration from the second arithmetic map.

Eighth, the vehicle is characterized in that it has acceleration detection means for detecting acceleration of the vehicle in the longitudinal direction, that the rate of deceleration thereof is deceleration of the vehicle detected by the acceleration detection means, and that the increasing-start rotation speed setting means sets the second rotation speed on the high rotation speed side as the deceleration increases.

Ninth, the increasing-start rotation speed setting means is characterized in that it sets the second rotation speed on the high rotation speed side in proportion to the magnitude of the deceleration in the longitudinal direction when the deceleration exceeds a predetermined deceleration.

Tenth, the return rotation speed setting means is characterized by setting the first rotation speed on the basis of the deceleration rate of the internal-combustion engine or a vehicle mounted with the internal-combustion engine thereon.

Eleventh, the return rotation speed setting means is characterized by setting the first rotation speed on the high rotation speed side as the deceleration rate becomes higher.

Twelfth, the ordinary fuel control mode is characterized by including at least a first air-fuel ratio mode which is set such that the target air-fuel ratio becomes substantially equal to the theoretical air-fuel ratio, and a second air-fuel ratio mode which is set such that the target air-fuel ratio becomes an air-fuel ratio on the leaner side than the first air-fuel ratio mode.

Thirteenth, the mode selection means is characterized by selecting the second air-fuel ratio mode when the amount of intake air is increased and corrected by the intake air amount correction means upon returning from the fuel cut mode to the ordinary fuel control mode.

Fourteenth, the mode selection means is characterized by correcting the target air-fuel ratio in the second air-fuel ratio mode closer to the theoretical air-fuel ratio side than the air-fuel ratio previously set when increase and correction in the amount of intake air by the intake air amount correction means have not been completed.

Fifteenth, the intake air amount correction means is characterized by increasing and correcting the amount of intake air when the second air-fuel ratio mode is selected, and reducing the corrected amount for the amount of intake air when the mode is switched from the second air-fuel ratio mode to the fuel cut mode while the amount of intake air is being increased and corrected.

Sixteenth, when the deceleration rate of the internal-combustion engine or a vehicle mounted with the internal-combustion engine thereon is high, the target air-fuel ratio of the second air-fuel ratio mode is characterized by being corrected closer to the theoretical air-fuel ratio side than the air-fuel ratio previously set.

Accordingly, when the deceleration rate is high, the second rotation speed is corrected close to the high rotation speed side to advance the time of increasing the amount of air, thus preventing the rotation speed from being lowered upon resuming fuel-supply in the fuel cut mode during rapid deceleration.

Seventeenth, the fuel injection device is characterized in that it has a fuel injection valve for directly supplying fuel into the combustion chamber, that the ordinary fuel control mode includes the compression stroke injection mode in which the target air-fuel ratio is set in such a manner that the target air-fuel ratio becomes an air-fuel ratio closer to the leaner side than the second air-fuel ratio mode and fuel injection is performed mainly in the compression stroke, and that the mode selection means selects the compression stroke injection mode upon returning from the fuel cut mode to the ordinary fuel control mode.

Accordingly, the compression stroke injection mode, having good response characteristic and combustion, is selected during fuel return from the fuel cut mode, whereby it is possible to prevent the rotation speed from lowering during fuel return from the fuel cut mode, to set the first predetermined rotation speed, which is the return rotation speed, close to the lower rotation speed side, and to further enlarge the implement rotation speed range of the fuel cut mode, thus improving the fuel consumption.

Eighteenth, the internal-combustion engine is characterized in that it is provided with throttle valves, provided in intake passages conductively connected to the combustion chamber, for being opened or closed correspondingly to an operating amount of an accelerator pedal; the intake air amount correction means includes an air by-pass passage conductively connected to the intake passages on the upstream side and on the downstream side of the throttle valves, having the same passage cross-sectional area as the intake passages, and an air by-pass valve for controlling the passage cross-sectional area of the air by-pass passage; and when the second air-fuel ratio mode or the compression stroke injection mode is selected by the mode selection means, the intake air amount correction means controls the air by-pass valve to increase and correct the amount of intake air in correspondence with the operating condition, and when the fuel cut mode is selected, it controls the air by-pass valve to reduce the correction amount for the amount of intake air.

Nineteenth, the internal-combustion engine is characterized in that it is provided with electrically-driven throttle valves provided in intake passages conductively connected to the combustion chamber, for being open-close controlled to obtain a target throttle valve opening to be set at least on the basis of the operating condition of the accelerator pedal; the intake air amount correction means is constructed such that the amount of intake air is increased by setting to a larger opening than the target throttle valve opening to introduce such an amount of intake air as required for the compression stroke injection mode; and when the second air-fuel ratio mode or the compression stroke injection mode is selected by the mode selection means, the intake air amount correction means controls the electrically-driven throttle valves to increase and correct the amount of intake air in correspondence with the operating condition, and when the fuel cut mode is selected, the control means controls the electrically-driven throttle valves to reduce the correction amount for the amount of intake air.

Twentieth, when the deceleration rate of the internal-combustion engine or a vehicle mounted with the internal-combustion engine thereon is high, the target air-fuel ratio of the compression stroke injection mode is characterized by being corrected closer to the target air-fuel ratio side in the second air-fuel ratio mode than an air-fuel ratio previously set.

BRIEF DESCRIPTION OF THE DRAWINGS

FIG. 4(*b*) is a flowchart showing control of an amount of air on stopping and resuming fuel-supply in fuel cut mode according to an embodiment of the present invention; and FIG. 4(*c*) is a flowchart showing control of an amount of air on stopping and resuming fuel-supply in fuel cut mode according to another embodiment of the present invention.

DETAILED DESCRIPTION OF PREFERRED EMBODIMENT

The description will be made of an embodiment according to the present invention with reference to the drawings hereinafter.

Figure 1:
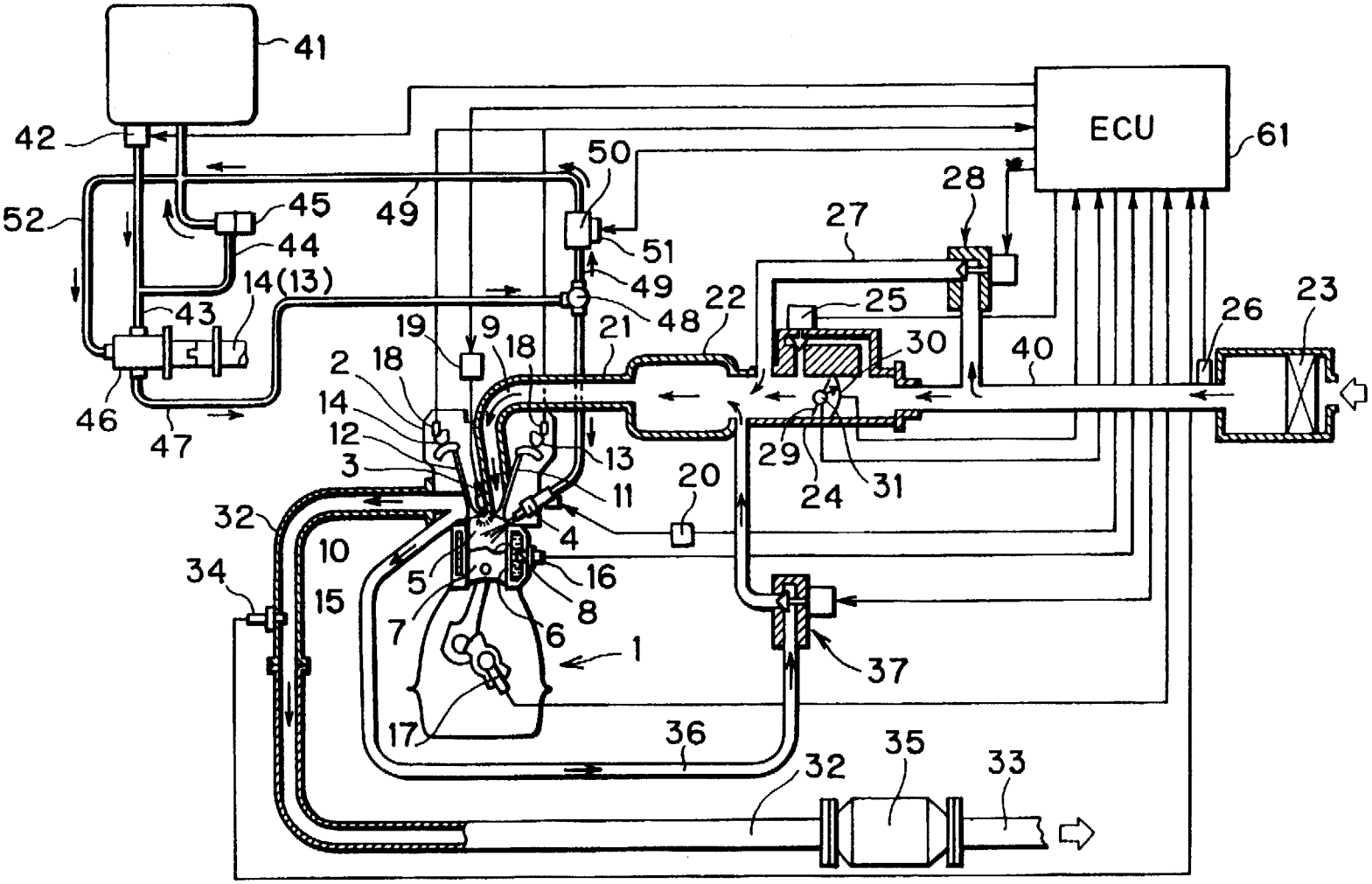
FIG. 1 is a schematic structural view showing a multi-cylinder type in-cylinder injection internal-combustion engine provided with a control device for controlling an amount of air according to an embodiment of the present invention.

The description will be made of the structure of a multi-cylinder type in-cylinder injection internal-combustion engine in conjunction with FIG. 1. As the multi-cylinder type in-cylinder injection internal-combustion engine, for example, an in-cylinder injection type straight four-cylinder gasoline engine (in-cylinder injection engine) 1, in which fuel is directly injected into a combustion chamber, is applied. In the in-cylinder injection engine 1, the combustion chamber, intake device, exhaust gas recirculation system (EGR system) and the like are designed exclusively for in-cylinder injection.

In the in-cylinder injection engine 1, a cylinder head 2 is provided with an ignition plug 3 for each cylinder, and with an electromagnetic type fuel injection valve 4 as the fuel-supply means for each cylinder. Within a combustion chamber 5, an injection nozzle for the fuel injection valve 4 is provided such that fuel injected from the fuel injection valve 4 through a driver 20 is directly injected into the combustion chamber 5. In a cylinder 6 of the in-cylinder injection engine 1, a piston 7 is supported slidably in an up and down direction, and on the top surface of the piston 7, a semi-spherically recessed cavity 8 is formed. The cavity 8 promotes the formation of vertical gyrating flow due to intake air which is flowed from an intake port to be described later.

The cylinder head 2 is formed with an intake port 9 and an exhaust port 10 which face the combustion chamber 5, and the intake port 9 is opened or closed by the driving of the intake valve 11 while the exhaust port 10 is opened or closed by the driving of the exhaust valve 12. On the upper portion of the cylinder head 2, an intake-side cam shaft 13 and an exhaust-side cam shaft 14 are rotatably supported, and the intake valve 11 is driven by the rotation of the intake-side cam shaft 13 while the exhaust valve 12 is driven by the rotation of the exhaust-side cam shaft 14. On the exhaust port 10, a large diameter exhaust gas recirculation port (EOR port) 15 is branched obliquely downward.

In the vicinity of the cylinder 6 of the in-cylinder injection engine 1, a water temperature sensor 16 is provided for detecting the cooling water temperature. Also, a vane type crank angle sensor 17, which outputs a crank angle signal SGT at a predetermined crank position (for example, 75 degrees BTDC and 5 degrees BTDC) of each cylinder to detect the engine rotation speed, is provided. Also, on cam shafts 13 and 14, which rotate at a rotation speed half as fast as the crankshaft, a discrimination sensor 18 for outputting a cylinder discrimination signal SGC is provided, so that it can be discriminated through the cylinder discrimination signal SGC to which cylinder the crank angle signal SGT corresponds. In this respect, reference numeral 19 in the figure designates an ignition coil which applies high voltage to the ignition plug 3.

To the intake port 9, an intake pipe 40 is connected through an intake manifold 21, and the intake manifold 21 is provided with a surge tank 22. Also, the intake pipe 40 is provided with an air cleaner 23, a throttle body 24, a first air by-pass valve 25 of stepper motor type, and an air flow sensor 26. The air flow sensor 26 is used to detect an amount of intake air, and in the present embodiment, for example, a Carman vortex type flow sensor is used. In this respect, a boost pressure sensor can also be mounted to the surge tank 22 to determine the amount of intake air from intake pipe pressure detected by the boost pressure sensor.

On the intake pipe 40, a large-diameter air by-pass pipe 27, which inhales air into the intake manifold 21 around the throttle body 24, is provided, and the air by-pass pipe 27 is provided with a second air by-pass valve 28 of a linear solenoid type. The air by-pass pipe 27 has a passage area in proportion to the intake pipe 40, and inhaling of air of an amount required in the low and medium speed areas of the in-cylinder injection engine 1 is made possible during full opening of the second air by-pass valve 28.

The throttle body 24 is provided with a butterfly throttle valve 29 for opening or closing the passage and with a throttle position sensor 30 for detecting the opening of the throttle valve 29. From the throttle position sensor 30, which detects the opening of the throttle valve 29, a throttle voltage corresponding to the opening amount of the throttle valve 29 is so outputted as to recognize the opening of the throttle valve 29 on the basis of the throttle voltage. Also, the throttle body 24 is provided with an idle switch 31 for detecting a full-closed state of the throttle valve 29 to recognize an idling state of the in-cylinder injection engine 1.

On the other hand, to the exhaust port 10, an exhaust pipe 33 is connected through an exhaust manifold 32, to which a $O_2$ sensor 34 is mounted. Also, the exhaust pipe 33 is provided with a catalytic converter rhodium 35 and a silencer (not shown). Also, the EPG port 15 is connected to the intake manifold 21 on the upstream side through the large-diameter EGR pipe 36, which is provided with a EGR valve 37 of stepper motor type.

The fuel stored in a fuel tank 41 is pumped up by an electrically-driven low-pressure fuel pump 42, and delivered to the side of the in-cylinder injection engine 1 through a low-pressure feed pipe 43. The fuel pressure within the low-pressure feed pipe 43 is adjusted to a comparatively low pressure (low fuel pressure) by a first fuel pressure regulator 45 provided in a return pipe 44. The fuel delivered to the side of the in-cylinder injection engine 1 is delivered to each fuel injection valve 4 through a high-pressure feed pipe 47 and a delivery pipe 48 by a high-pressure fuel pump 46.

The high-pressure fuel pump 46 of, for example, swash plate axial piston type is so arranged to be driven by the cam shaft 14 on the exhaust side or the cam shaft 13 on the intake side as to generate discharge pressure not less than a predetermined pressure even during idling operation of the in-cylinder injection engine 1. The fuel pressure within the delivery pipe 48 is adjusted to a comparatively high pressure (high fuel pressure) by a second fuel pressure regulator 50 provided in a return pipe 49.

The second fuel pressure regulator 50 is mounted with an electromagnetic type fuel pressure selector valve 51, which is capable of releasing fuel in an ON-state to reduce the fuel pressure within the delivery pipe 48 into low fuel pressure. In this respect, reference numeral 52 in the figure designates a return pipe for returning a part of fuel utilized for lubrication or cooling for the high-pressure fuel pump 46 to the fuel tank 41.

A vehicle is provided with an electronic control unit (ECU) 61 as a control device, which is provided with an I/O device, a storage unit for storing control programs, control maps and the like, a central processing unit, timers and counters. The ECU 61 comprehensively controls the in-cylinder injection engine 1. Detection information by the aforesaid various sensors is inputted in the ECU 61, which determines ignition timing, amount of introduced EGR gas and the like including fuel injection mode and fuel injection quantity on the basis of the detection information by various sensors to drivingly control the driver 20 for the fuel injection valve 4, ignition coil 19, EGR valve 37 and the like.

In this respect, on the input side of the ECU 61, a large number of switches (not shown) are connected in addition to the aforesaid various sensors, and on the output side thereof, various warning means and apparatus group (not shown) are also connected.

In the aforesaid in-cylinder injection engine 1, when a driver of a vehicle turns on the ignition key while the in-cylinder injection engine 1 is in a cold state, the low-pressure fuel pump 42 and the fuel pressure selector valve 51 are turned on to supply fuel at low fuel pressure to the fuel injection valve 4. Next, when the driver operates the ignition key for starting, the sel-motor (not shown) cranks the in-cylinder injection engine 1 to, at the same time, start fuel injection control by the ECU 61.

At this point of time, the ECU 61 selects a former-period injection mode (that is, mode in which fuel is injected in the intake stroke) and injects fuel to provide a comparatively rich air-fuel ratio.

At the time of such starting, the second air by-pass valve 28 is almost fully closed. Therefore, the amount of air intake into the combustion chamber 5 is effected through a clearance in the throttle valve 29 or the first air by-pass valve 25. In this respect, the first air by-pass valve 25 and the second air by-pass valve 28 are one-way controlled by the ECU 61 so that their respective amounts of valve opening are determined in accordance with a required amount of intake air going around the throttle valve 29.

When starting of the in-cylinder injection engine 1 is thus completed and the in-cylinder injection engine 1 starts an idle operation, the high-pressure fuel pump 46 starts a rated discharge operation, and the fuel pressure selector valve 51 is turned off by the ECU 61 to supply fuel at high pressure to the fuel injection valve 4. The demanded fuel injection quantity at this time can be determined from, for example, the set fuel pressure of, for example, the second fuel pressure regulator 50 or the fuel pressure within the delivery pipe 48 detected by a fuel pressure sensor (not shown) and the valve-opening time of the fuel injection valve 4.

Before the cooling water temperature detected by the water temperature sensor 16 rises to a predetermined value, the former-period injection mode is selected in the same manner as during starting to inject fuel. The idle rotation speed is controlled by the first air by-pass valve 25 in correspondence with increase or decrease in loads by auxiliary systems machines such as an air conditioner. When the $O_2$ sensor 34 is activated after predetermined cycles pass, air-fuel ratio feedback control is started in accordance with the output voltage from the $O_2$ sensor 34. This control purifies harmful exhaust gas constituent with catalytic converter rhodium 35 satisfactorily.

Figure 2:
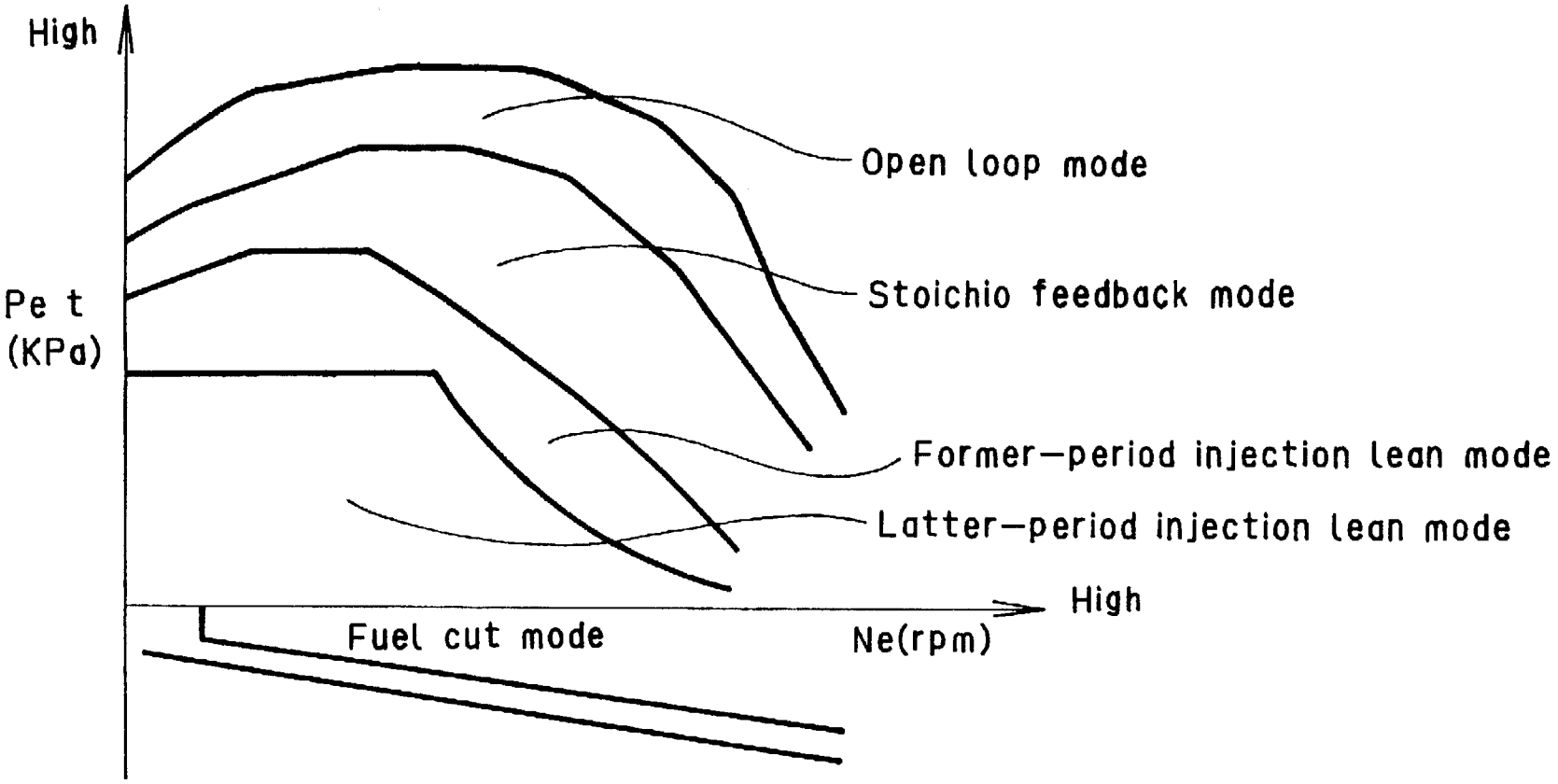
FIG. 2 is a fuel injection control map.

On completion of warming-up of the in-cylinder injection engine 1, the ECU 61 retrieves a present fuel injection area from the fuel injection map of FIG. 2 on the basis of a target output correlated value obtained from the throttle voltage corresponding to the opening of the throttle valve 29, for example, target mean effective pressure Pet, and the engine rotation speed to determine the fuel injection mode. In this way, the fuel injection quantity corresponding to target air-fuel ratio in each fuel injection mode is determined to drivingly control the fuel injection valve 4 in correspondence with the fuel injection quantity and also the ignition coil 19. Also, the first air by-pass valve 25, the second air by-pass valve 28 and EGR valve 37 are open-close controlled at the same time.

In a low-load area such as during an idle operation and during running at low speeds, a latter-period injection lean mode in FIG. 2 is selected as the fuel injection area. In this case, the first air by-pass valve 25 and the second air by-pass valve 28 are controlled, and the target air-fuel ratio corresponding to the target mean effective pressure Pet is set on the basis of the throttle voltage and the engine rotation speed to provide a lean air-fuel ratio. Thus, the fuel injection quantity corresponding to the target air-fuel ratio is set, and the fuel injection valve 4 is drivingly controlled to inject fuel in conformity with the fuel injection quality.

Also, in a medium load area such as during running at a fixed speed, a former-period injection lean mode in FIG. 2 or a stoichio feedback mode is selected depending upon the engine load state and the engine rotation speed. In the former-period injection lean mode, the first air by-pass valve 25 is controlled in the same manner as an ordinary idle speed control valve, and the target air-fuel ratio is calculated in conformity with a signal for amount of intake air from the air flow sensor 26 and the engine rotation speed to control the fuel injection quantity to provide a comparatively lean air-fuel ratio.

In the stoichio feedback mode, in the same manner as the former-period injection lean mode, the first air by-pass valve 25 is controlled in the same manner as the ordinary idle speed control valve, and the second air by-pass valve 28 is fully closed to prevent any excessive rise in the output. Further, the EGR valve 37 is controlled, and the air-fuel ratio feedback control is effected in correspondence with the output voltage from the $O_2$ sensor 34 so that the target air-fuel ratio becomes equal to the theoretical air-fuel ratio, and thus the fuel injection quantity is controlled.

Also, in a high-load area such as during rapid acceleration and during high-speed running, an open loop mode in FIG. 2 is selected. In this case, the second air by-pass valve 28 is closed, and the target air-fuel ratio is set from the map to obtain a comparatively rich air-fuel ratio to control the fuel injection quantity in correspondence with this target air-fuel ratio.

In a running condition, which shifts to coasting running or stop, during an operation in which the throttle valve 29 is placed in a substantially idle state and the idle switch 31 is turned ON, a fuel cut mode in FIG. 2 is selected. In this case, fuel-supply to the combustion chamber 5 is stopped. In the fuel cut mode, if the engine rotation speed reduces below a return rotation speed (first rotation speed), fuel-supply to the combustion chamber 5 is resumed by a latter-period injection lean mode (lean side air-fuel ratio mode). Also, even when the driver depresses the accelerator pedal, the fuel cut mode is discontinued immediately, and fuel-supply to the combustion chamber 5 is resumed by one of the modes suitable for the operating condition at the time.

Now, if the engine rotation speed reduces below the return rotation speed in running which shifts to stop, fuel-supply to the combustion chamber 5 is resumed, but in the fuel cut mode, there is a possibility that since the amount of intake air has been reduced, the amount of air is insufficient upon resuming fuel-supply and cause a torque down. Therefore, the amount of air is controlled to prevent any torque down by increasing the amount of air before the fuel-supply is resumed in the fuel cut mode.

Figure 3:
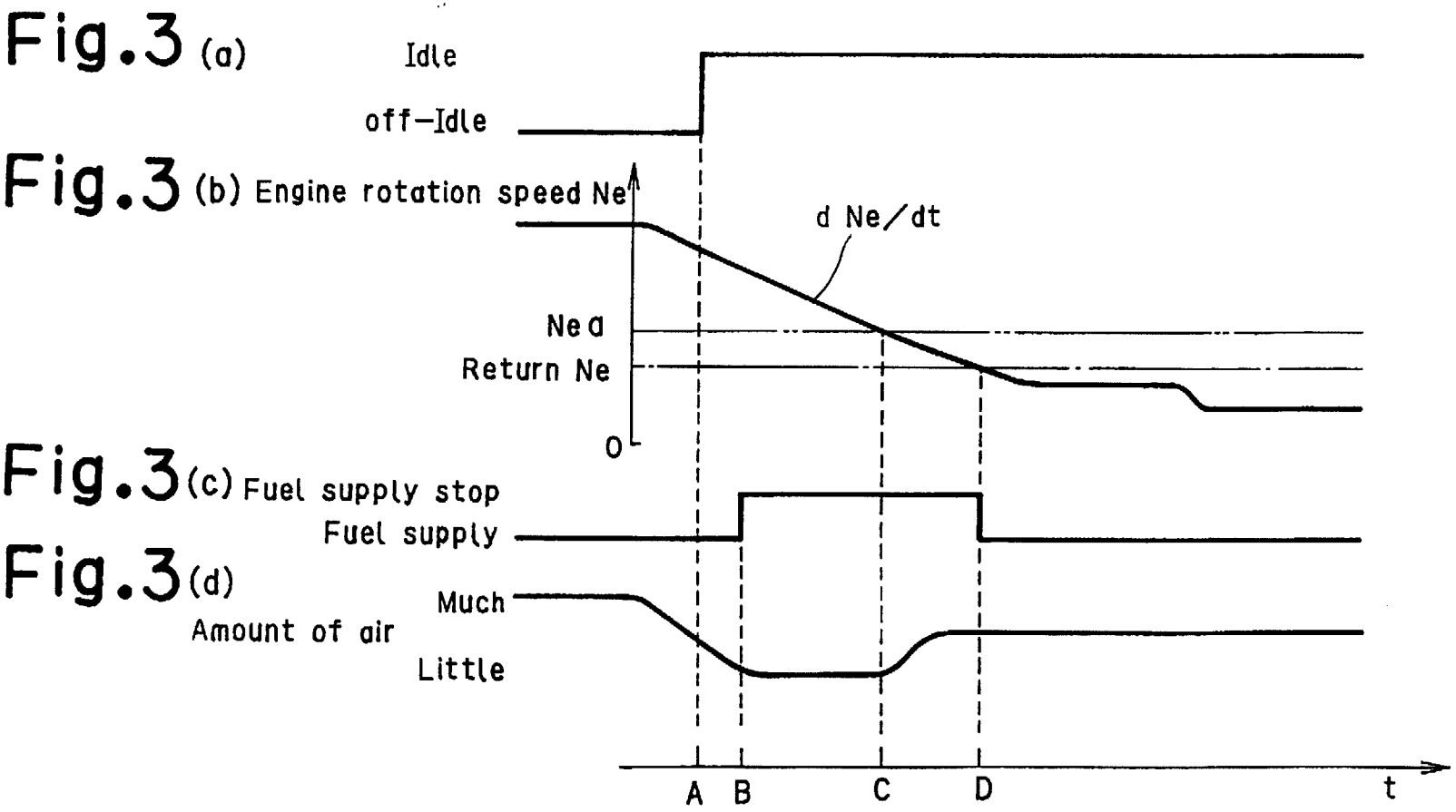
FIGS. 3(*a*)–(*d*) are timing chart showing control of an amount of air on resuming fuel-supply in fuel cut mode.
Figure 4A:
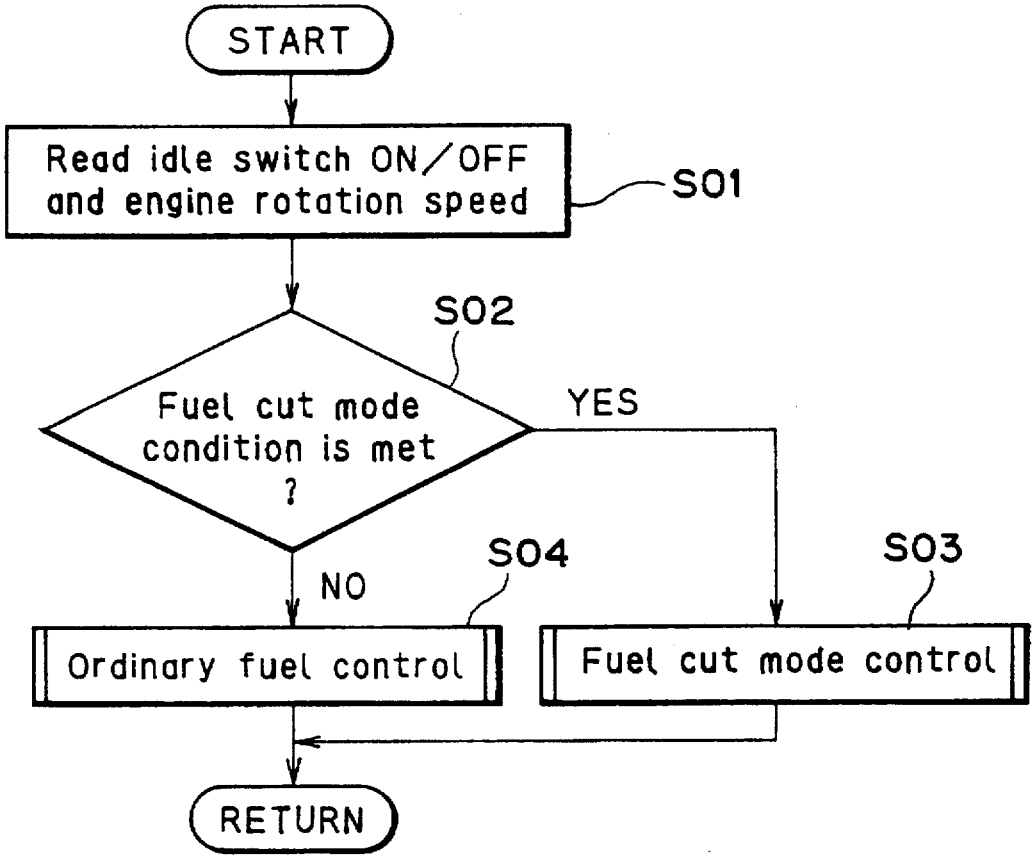
FIG. 4(*a*) is a flowchart showing determination of start of fuel cut mode control.
Figure 4B:
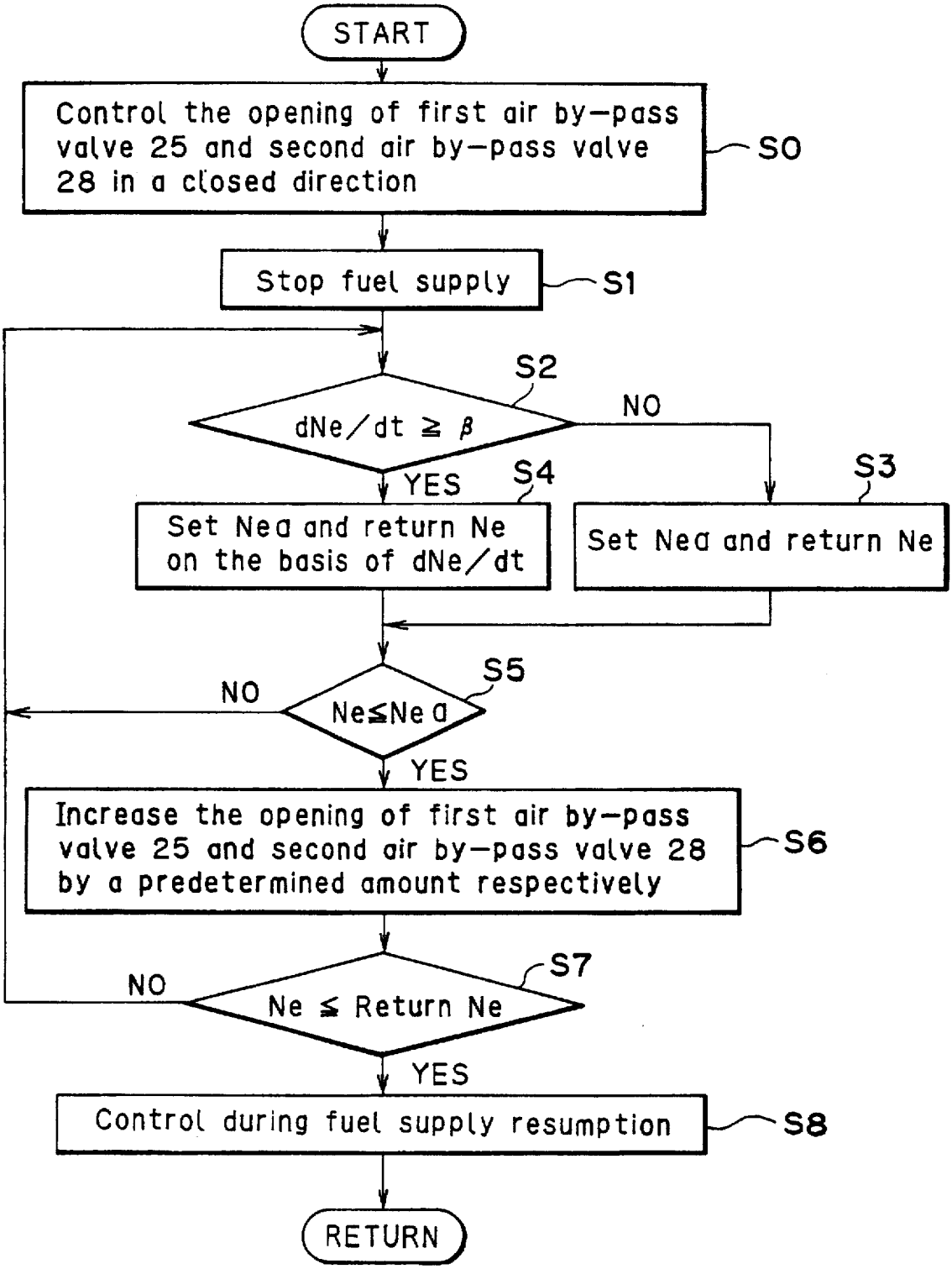

In conjunction with FIGS. 3, 4(*a*) and (*b*), the description will be made of the control of amount of air during fuel return. FIG. 3 shows a timing chart for control of amount of air during fuel return in the fuel cut mode. FIG. 3(*a*) shows the open and close condition of the throttle valve 29; FIG. 3(*b*) shows the condition of engine rotation speed; FIG. 3(*c*) shows the condition of fuel-supply; and FIG. 3(*d*) shows a condition of the amount of air. FIG. 4(*a*) shows a flowchart for determination of start of fuel cut mode control, and FIG. 4(*b*) shows a flowchart of control of amount of air during fuel return in fuel cut mode.

In conjunction with FIG. 3, the description will be made of each condition in the fuel cut mode. When the vehicle is in a decelerating state, for example, when the vehicle decelerates to stop, the amount of air decreases as shown in FIG. 3(*d*) and engine rotation speed Ne also decreases accordingly. When, as shown by point A in FIG. 3(*a*), the throttle valve 29 is placed in an idle state, the idle switch 31 is turned ON, and the engine rotation speed exceeds a lower limit rotation speed at which fuel cut can be allowed, that is, when the condition for fuel cut mode is met, the first air by-pass valve 25 and the second air by-pass valve 28 are first rotated in a close direction (point A in FIG. 3), and further, fuel-supply is stopped at point B as shown in FIG. 3(*c*). Up to the point B in FIG. 3, namely until fuel-supply is stopped since this decelerated running is started, the throttle valve is driven in a close direction to enter an idle state as shown in FIG. 3(*d*), and the first air by-pass valve 25 and the second air by-pass valve 28 are controlled in a close direction. Thus, the amount of air gradually decreases. In this state, as shown in FIG. 3(*b*) from up to point D, the engine rotation speed Ne gradually reduces. When the engine rotation speed Ne reduces to the return rotation speed (return Ne), which is a rotation speed at which fuel-supply is resumed, fuel-supply is resumed as shown in FIG. 3(*c*) at point D so that the engine rotation speed Ne is maintained at a predetermined rotation speed (for example, idle rotation state). In this respect, the return rotation speed (return Ne) for resuming fuel-supply is arranged to be set or changed in correspondence with the engine operating condition or increase or decrease in loads by auxiliary systems such as an air conditioner.

On the other hand, a deceleration rate in the engine rotation speed Ne, that is, the rate of change of deceleration (dNe/dt) of the engine rotation speed Ne is operated to set the return rotation speed (return Ne), which is the first rotation speed, and the rotation speed for increasing the amount of air Nea, which is a second rotation speed, on the basis of the rate of change in deceleration (dNe/dt). In other words, the higher the rate of change in deceleration (dNe/dt) is, the return rotation speed (return Ne) and the rotation speed for increasing the amount of air Nea are corrected closer to the high rotation speed side. The rotation speed for increasing the amount of air Nea is set closer to the high rotation speed side than the return rotation speed (return Ne), and when the engine rotation speed Ne reaches the rotation speed for increasing the amount of air Nea (point C), the amount of air is increased prior to resumption of fuel-supply as shown in FIG. 3(*d*) (function of increasing the amount of air). The amount of air is increased by means of valve-opening control by the first air by-pass valve 25 and the second air by-pass valve 28 as the correction means. Here, as the target opening for the first air by-pass valve 25 and the second air by-pass valve 28, it is set to an opening at which the amount of air during idle operation in the compression stroke injection mode can be substantially obtained. Accordingly, since the amount of air is arranged to be increased prior to resumption of fuel-supply, there is no possibility that the amount of air becomes insufficient during resumption of fuel-supply to cause a torque down. Also, since fuel supply is resumed at the optimum return rotation speed (return Ne) suitable for the engine operating condition, it becomes possible to enlarge implement rotation speed ranges for the torque down, which is caused when the return rotation speed (return Ne) is too low or too high for the engine operating state, and the fuel cut mode, thus improving the fuel consumption.

Also, since the return rotation speed (return Ne) and the rotation speed for increasing the amount of air Nea are set on the basis of the rate of change in deceleration (dNe/dt) of the engine rotation speed Ne, the amount of air can be increased for a period of time expected until fuel-supply is resumed, and the amount of air can be surely increased during resumption of fuel-supply even during rapid deceleration. Further, the resumption of fuel-supply can be changed in correspondence with the deceleration rate in the engine rotation speed, and even during rapid deceleration, it is possible to prevent engine stall resulting from lowered engine rotation speed during fuel return. Also, during slow deceleration, since the return rotation speed (return Ne) and the rotation speed for increasing the amount of air Nea can be set closer to the low rotation speed side than during the rapid deceleration, it becomes possible to enlarge the implement rotation speed range for fuel cut mode, thus improving the fuel consumption. In this respect, on setting the rotation speed for increasing the amount of air Nea, it is possible to use a value (return Ne+$\alpha$) obtained by adding a fixed value $\alpha$ for the return rotation speed (return Ne). In this case, there is no need for a map for setting the rotation speed for increasing the amount of air Nea in correspondence with the deceleration rate, and it becomes possible to set the rotation speed for increasing the amount of air Nea by means of simple control. Also, on setting the return rotation speed (return Ne) , it is possible to use a value (Nea–$\alpha$) obtained by deducting a fixed value $\alpha$ for the rotation speed for increasing the amount of air Nea. In this case, there is no need for a map for setting the return rotation speed (return Ne) in correspondence with the deceleration rate, and it is possible to set the return rotation speed (return Ne) by means of simple control. Also, on setting the return rotation speed (return Ne) and the rotation speed for increasing the amount of air Nea, a fixed value in correspondence with the operating state can be used. In this case, the logic for calculation can be simplified.

In conjunction with FIGS. 4(*a*) and (*b*), the control method in fuel cut mode will be described. FIG. 4(*a*) is a flowchart showing determination of start of fuel cut mode control. In step S01, the ON/OFF state of the idle switch 31 and the engine rotation speed Ne are read. In step S02, it is determined whether or not the engine rotation speed Ne exceeds a lower limit rotation speed at which fuel cut can be allowed with the idle switch 31 ON, that is, whether or not the fuel cut mode can be started. If it is found that the fuel cut mode condition has been met, the control in fuel cut mode can be effected on the basis of the flowchart of FIG. 4(*b*) (step S03). If, on the other hand, the idle switch 31 is OFF or the engine rotation speed Ne is below the lower limit rotation speed at which fuel cut can be allowed, and it is found that the fuel cut mode condition is not met, the ordinary fuel injection control will be effected on the basis of a control flowchart (not shown) in predetermined mode suitable for the operating condition at the time (step S04).

Next in conjunction with FIG. 4(*b*), the concrete description will be made of control of amount of air during fuel-supply stop and during resumption of fuel-supply in fuel cut mode.

When the fuel cut mode condition is met, the opening of the first air by-pass valve 25 and the second air by-pass valve 28 is controlled in a close direction (for example, almost full closed) in step S0 (point A in FIG. 3). Further in step S1, fuel-supply is stopped (point B in FIG. 3). In step S2, it is determined whether or not the rate of change in deceleration (dNe/dt) of the engine rotation speed Ne exceeds a predetermined value $\beta$, that is, whether or not the deceleration rate of the engine rotation speed Ne is high.

If the rate of change in deceleration (dNe/dt) is found to be below the predetermined value $\beta$, the deceleration rate of the engine rotation speed Ne is low and it is not in a rapid decelerated state, and therefore, the return rotation speed (return Ne) and the rotation speed for increasing the amount of air Nea are set in the step S3. In step S2, if the rate of change in deceleration (dNe/dt) of the engine rotation speed Ne is found to exceed the predetermined value $\beta$, the deceleration rate of the engine rotation speed Ne is high and it is in a rapid decelerated state, and therefore, the return rotation speed (return Ne) and the rotation speed for increasing the amount of air Nea are set on the basis of the rate of change in deceleration (dNe/dt) in step S4. For example, the return rotation speed (return Ne) and the rotation speed for increasing the amount of air Nea are set close to the high rotation speed side in proportion to the magnitude of the rate of change in deceleration (dNe/dt). In this respect, it is possible, in the step S2, to set the return rotation speed (return Ne) and the rotation speed for increasing the amount of air Nea by means of a map or the like on the basis of the rate of change in deceleration (dNe/dt) without determining whether or not the rate of change in deceleration (dNe/dt) of the engine rotation speed Ne exceeds the predetermined value $\beta$.

When the return rotation speed (return Ne) and the rotation speed for increasing the amount of air Nea are set in step S3 or step S4, it is determined in step S5 whether or not the engine rotation speed Ne is not more than the rotation speed for increasing the amount of air Nea (whether or not point C is reached in FIG. 3). In step S5, if the engine rotation speed Ne is found to exceed the rotation speed for increasing the amount of air Nea, the sequence will proceed to the processing in step S2 to set the return rotation speed (return Ne) and the rotation speed for increasing the amount of air Nea again. In step S5, if the engine rotation speed Ne is found to be below the rotation speed for increasing the amount of air Nea, that is, if the engine rotation speed Ne is found to have reached the rotation speed for increasing the amount of air Nea, the opening of the first air by-pass valve 25 and the second air by-pass valve 28 is increased by a predetermined amount in step S6 to increase the amount of air prior to resumption of fuel-supply.

After the amount of air is increased in step S6, the engine rotation speed Ne and the return rotation speed (return Ne) are compared in step S7 (whether or not point D is reached in FIG. 3). In step S7, if the engine rotation speed Ne is found not to have reached the return rotation speed (return Ne), the sequence will proceed to the processing in step S2 to set the return rotation speed (return Ne) and the rotation speed for increasing the amount of air Nea again. Here, since the rotation speed for increasing the amount of air Nea is also set over again newly, there is a possibility that a negative determination is given again in step S5 if the rate of change in deceleration (dNe/dt) of the engine rotation speed Ne becomes low, for example, after the amount of air is increased. However, it is possible to prevent such aproblem by conducting processing such as setting a flag when an affirmative determination is first given in step S5. In step S7, if the engine rotation speed Ne is found to be not more than the return rotation speed (return Ne), that is, if the engine rotation speed Ne is found to have reached the return rotation speed (return Ne), the control during fuel return is effected in step S8 to resume fuel-supply. At this time, if the aforesaid rate of change in deceleration (dNe/dt) is high, it may be possible to correct the target air-fuel ratio closer to the rich side than the ordinary air-fuel ratio of compression stroke injection mode.

During resumption of fuel-supply, fuel-supply into the combustion chamber 5 is resumed by means of the latter-period injection lean mode, in which fuel is injected in the compression mode, that is, the compression stroke mode (lean side air-fuel ratio mode) having good response characteristic and combustion. At this time, if the rate of change in deceleration (dNe/dt) of the engine rotation speed Ne is high, it is possible to increase the output during fuel return by correcting the target air-fuel ratio in the latter-period injection lean mode to the concentration side, that is, rich side (lean state to the theoretical air-fuel ratio).

As described above, in the control of the amount of air according to the present embodiment, when the engine rotation speed Ne reduces to the rotation speed for increasing the amount of air Nea on the higher rotation speed side than the return rotation speed (return Ne) during operation in the fuel cut mode, the amount of air is increased, and when the engine rotation speed Ne reduces to the return rotation speed (return Ne) in a state in which the amount of air has been increased, fuel-supply is resumed. For this reason, the amount of air is increased before fuel-supply is resumed, and fuel-supply is resumed at the optimum return rotation speed (return Ne) suitable for the operating state without any deficiency in the amount of air during resumption of fuel-supply. Therefore, it is possible to improve the fuel consumption while preventing the engine rotation speed from becoming excessively low during return from the fuel cut mode, and avoiding torque down due to a deficiency in fuel injection quantity resulting from insufficient amount of intake air.

Also, in the embodiment described above, the higher the rate of change in deceleration (dNe/dt) of the engine rotation speed Ne is, the rotation speed for increasing the amount of air Nea is arranged to be corrected close to the high rotation speed side. Therefore, the amount of air is sufficiently secured even during resumption of fuel-supply in a rapid decelerated state, thus making it possible to prevent the engine rotation speed Ne from reducing. Also, when the rate of change in deceleration (dNe/dt) of the engine rotation speed Ne is high, the target air-fuel ratio is corrected closer to the rich side, and therefore, the engine rotation speed Ne can be prevented from reducing even during fuel return in a rapid decelerated state.

Also, since the aforesaid embodiment is applied to an in-cylinder injection engine capable of selecting the latter-period injection lean mode, in which fuel injection is effected in the compression stroke to select the latter-period injection lean mode having good response characteristic and combustion during resumption of fuel-supply, it is possible to prevent the engine rotation speed Ne from reducing during resumption of fuel-supply, and to set the return rotation speed (return Ne) close to the lower rotation side than the ordinary intake injection type engine, thus enlarging the fuel cut mode to further improve the fuel consumption. Further, since the air-fuel ratio is not excessively increased, the periphery of the ignition plug is not made excessively rich, but any accidental fire can be prevented.

In this respect, in the aforesaid embodiment, the amount of air is controlled by controlling the opening of an air by-pass valve which by-passes the throttle valve, but it is possible to apply the present invention also to a motor-driven type electronic control throttle valve which is not directly linked to an accelerator pedal, so-called drive bywire (hereinafter, referred to as DBW). In this case, the accelerator pedal is provided with, for example, an accelerator pedal position sensor (hereinafter, referred to as ATS), and the opening of the electronic control throttle valve provided on the throttle body is controlled on the basis of accelerator pedal voltage VAC corresponding to an amount of pressing-down OAC of the accelerator pedal from APS, and its variations. In such a DBW type engine, in case of increasing and correcting the amount of intake air required for the lean air-fuel ratio, the amount of air can be increased by correcting the throttle valve opening in such a manner that the target throttle valve opening corresponding to the amount of pressing-down of the accelerator pedal becomes large depending upon the operating condition.

In this case, in order to secure an amount of intake air required for an idle operation even in the idle operating condition of the engine, the throttle valve is held at predetermined opening and is not fully closed, and therefore, a signal of the ATS is regarded as a condition for starting the fuel cut mode in place of the idle switch 31. Thus, the control is effected by a motor to fully close the throttle valve opening on reducing and controlling the amount of intake air during the fuel cut mode control, whereby the same effect as the aforesaid embodiment can be obtained. Also, although the description has been made of the example in which the present invention is applied to an in-cylinder injection engine 1 for directly injecting fuel into the combustion chamber 5 as an internal-combustion engine, it is also possible to apply the present invention to an internal-combustion engine in which fuel is injected in the intake pipe, and the present invention can be applied to a single-cylinder engine and a V-type six-cylinder engine as well as a four-cylinder in-cylinder injection engine 1.

Further, in conjunction with FIG. 4(*c*), the description will be made of a control method in fuel cut mode according to another embodiment of the present invention.

If it is found, in the flowchart for determination of start of fuel cut mode control in FIG. 4(*a*), that the fuel cut mode condition is met, the fuel cut mode control is effected.

Hereinafter, the control of amount of air during fuel-supply stop and during resumption of fuel-supply in fuel cut mode according to another embodiment of the present invention will be concretely described using the flowchart of FIG. 4(*c*).

When the fuel cut mode condition is met, the opening of the first air by-pass valve 25 and the second air by-pass valve 28 is controlled in a close direction (for example, gradually driving the valves by a predetermined amount at a time until almost fully closed) in step S11 (point A in FIG. 3). Further, in step S12, fuel-supply is stopped (point B in FIG. 3).

In step S13, it is determined whether or not the rate of change in deceleration (dNe/dt) of the engine rotation speed Ne exceeds a predetermined value β, that is, whether or not the deceleration rate of the engine rotation speed Ne is high. If the rate of change in deceleration (dNe/dt) is found to be below the predetermined value β, the deceleration rate of the engine rotation speed Ne is low and it is not in a rapid decelerated state, and therefore, the return rotation speed (return Ne) and the rotation speed for increasing the amount of air Nea, which are used for determination to be described later in step S14, are set to a previously determined first rotation speed and a second rotation speed on the higher rotation speed side than the first rotation speed respectively.

On the other hand, in step S13, if the rate of change in deceleration (dNe/dt) is found to be not less than the predetermined value β, the deceleration rate of the engine rotation speed Ne is high and it is in a rapid decelerated state, and therefore, the return rotation speed (return Ne) and the rotation speed for increasing the amount of air Nea, which are used for determination to be described later, are set on the basis of the rate of change in the deceleration (dNe/dt) in the step 15. For example, the return rotation speed (return Ne) and the rotation speed for increasing the amount of air Nea can be also set on the high rotation speed side in proportion to the magnitude of the rate of change in deceleration (dNe/dt).

When the return rotation speed (return Ne) and the rotation speed for increasing the amount of air Nea are set in step 14 or step 15, the engine rotation speed Ne at this point of time is read again in step S16. In step S17, it is determined whether or not the present engine rotation speed Ne is not more than the rotation speed for increasing the amount of air Nea (whether or not point C in FIG. 3 is reached). If the present engine rotation speed Ne is found to still exceed the rotation speed for increasing the amount of air Nea, steps S16 and S17 are repeated again. In step S17, if the present engine rotation speed Ne is found to be not more than the rotation speed for increasing the amount of air Nea (point C in FIG. 3), the opening of the first air by-pass valve 25 and the second by-pass valve 28 is controlled in step S18 so that it is increased at a predetermined rate to increase the amount of air prior to resumption of fuel-supply. On completion of the control of the opening of the first air by-pass valve 25 and the second air by-pass valve 28 in the step S18, the engine rotation speed Ne at this point of time is read again in step S19.

In step S20, it is determined whether or not the present engine rotation speed Ne is not more than the return rotation speed (return Ne) (whether or not point C is reached in FIG. 3). If the present engine rotation speed Ne is found to still exceed the return rotation speed (return Ne), the steps S19 and S20 are repeated again. In step S20, if the present engine rotation speed Ne is found to be not more than the return rotation speed (return Ne) (point D in FIG. 3), the control of resumption of fuel-supply is effected in step S21.

In the foregoing embodiment, since the optimum rotation speed for increasing the amount of air Nea and return rotation speed (return Ne) are set in correspondence with the operating condition, the amount of intake air is increased and corrected when the engine rotation speed becomes the rotation speed for increasing the amount of air Nea, and after completion of the increased and corrected amount of intake air, fuel-supply can be started when the engine rotation speed becomes the return rotation speed. Therefore, there are the effects that it is possible to prevent the engine rotation speed from excessively reducing during return from the fuel cut mode, and to increase the fuel consumption while avoiding the torque down due to an insufficient fuel injection quantity resulting from an insufficient amount of intake air. In addition to these effects, the control of the amount of intake air and the control of fuel during resumption of fuel-supply is simplified because after the return rotation speed (return Ne) and the rotation speed for increasing the amount of air Nea are once set in conformity with the rate of change in deceleration (dNe/dt), these rotation speeds (return Ne and Nea) will not be re-set.

In this respect, in the embodiment according to the present invention, the return rotation speed (return Ne) and the rotation speed for increasing the amount of air Nea have been set using the rate of change in deceleration of the engine rotation speed as the deceleration rate, but the present invention is not restricted thereto, but it maybe possible to provide acceleration detection means for detecting acceleration (α=dv/dt), in the longitudinal direction, of a vehicle mounted with an internal-combustion engine, and to set the return rotation speed (return Ne) and the rotation speed for increasing the amount of air Nea on the basis of the deceleration α of the vehicle. Also, at this time, when the deceleration α of the vehicle exceeds a predetermined acceleration α 0 previously determined, it may be possible to set the return rotation speed (return Ne) and the rotation speed for increasing the amount of air Nea on the high rotation speed side in proportion to the magnitude of the deceleration α of the vehicle respectively.

Further, when the return rotation speed (return Ne) and the rotation speed for increasing the amount of air Nea are set in proportion to the rate of change in deceleration of the engine rotation speed and the magnitude of the deceleration of the vehicle, a rate of increase in the rotation speed for increasing the amount of air Nea is preferably made to be higher than a rate of increase in the return rotation speed (return Ne).

What is claimed is:

1. A control device for an internal-combustion engine, comprising:

a fuel injection device for supplying fuel to a combustion chamber of the internal-combustion engine;

mode selection means including a fuel cut mode for stopping supply of fuel and an ordinary fuel control mode for supplying fuel, said mode selecting means selecting either said fuel cut mode or said ordinary fuel control mode on the basis of an operating condition of the internal combustion engine;

fuel control means for controlling said fuel injection device on the basis of the mode selected by said mode selection means;

intake air amount correction means for correcting an amount of intake air sucked into said combustion chamber;

return rotation speed setting means for setting a first rotation speed for resuming fuel-supply upon returning from said fuel cut mode to said ordinary fuel control mode;

increasing-start rotation speed setting means for setting a second rotation speed for starting increase and correction of the amount of intake air prior to resumption of fuel-supply upon returning from said fuel cut mode to said ordinary fuel control mode on the side of higher rotation speed than said first rotation speed; and rotation speed detection means for detecting a rotation speed of the internal-combustion engine, wherein said intake air amount correction means increases and corrects the amount of intake air when the rotation speed of said internal-combustion engine reduces to said second rotation speed, and said fuel control means resumes fuel-supply when the rotation speed of the internal-combustion engine reduces to said first rotation speed.

2. A control device for an internal-combustion engine as claimed in claim 1, wherein said increasing-start rotation speed setting means sets said second rotation speed on the basis of a deceleration rate of said internal-combustion engine or a vehicle mounted with said internal-combustion engine.

3. A control device for an internal-combustion engine as claimed in claim 2, wherein the deceleration rate of said internal-combustion engine is a rate of change in deceleration of said engine rotation speed, and said increasing-start rotation speed setting means sets said second rotation speed on the high rotation speed side as said rate of change in deceleration becomes higher.

4. A control device for an internal-combustion engine as claimed in claim 3, wherein said increasing-start rotation speed setting means sets said second rotation speed on the high rotation speed side in proportion to the magnitude of said rate of change in deceleration when said rate of change in deceleration exceeds a predetermined rate of change.

5. A control device for an internal-combustion engine as claimed in claim 4, wherein said return rotation speed setting means sets said first rotation speed on the high rotation speed side in proportion to the magnitude of said rate of change in deceleration when said rate of change in deceleration exceeds said predetermined rate of change.

6. A control device for an internal-combustion engine as claimed in claim 3, wherein said return rotation speed setting means sets said first rotation speed on the high rotation speed side as said rate of change in deceleration becomes higher, and sets a rate of increase in said first rotation speed so as to become lower than a rate of increase in said second rotation speed.

7. A control device for an internal-combustion engine as claimed in claim 2, wherein a deceleration rate of said internal-combustion engine is a rate of change in deceleration of the engine rotation speed, and said increasing-start rotation speed setting means includes a first arithmetic map for storing said second rotation speed previously is set on the basis of the magnitude of said rate of change in deceleration, and determines a second rotation speed corresponding to said rate of change in deceleration from said first arithmetic map.

8. A control device for an internal-combustion engine as claimed in claim 7, wherein said return rotation speed setting means includes a second arithmetic map for storing said first rotation speed previously is set on the basis of the magnitude of said rate of change in deceleration, and determines said first rotation speed corresponding to said rate of change in deceleration from said second arithmetic map.

9. A control device for an internal-combustion engine as claimed in claim 2, wherein said vehicle has acceleration detection means for detecting acceleration of said vehicle in the longitudinal direction, wherein the rate of deceleration thereof is deceleration of said vehicle detected by said acceleration detection means, and wherein said increasing-start rotation speed setting means sets said second rotation speed on the high rotation speed side as said deceleration becomes higher.

10. A control device for an internal-combustion engine as claimed in claim 9, wherein said increasing-start rotation speed setting means sets said second rotation speed on the high rotation speed side in proportion to the magnitude of said deceleration in the longitudinal direction when said deceleration exceeds a predetermined deceleration.

11. A control device for an internal-combustion engine as claimed in claim 1, wherein said return rotation speed setting means sets said first rotation speed on the basis of the deceleration rate of said internal-combustion engine or a vehicle mounted with said internal-combustion engine thereon.

12. A control device for an internal-combustion engine as claimed in claim 11, wherein said return rotation speed setting means sets said first rotation speed on the high rotation speed side as said deceleration rate becomes higher.

13. A control device for an internal-combustion engine as claimed in claim 1, wherein said ordinary fuel control mode includes at least first air-fuel ratio mode which is set such that the target air-fuel ratio becomes substantially equal to a theoretical air-fuel ratio, and second air-fuel ratio mode which is set such that the target air-fuel ratio becomes an air-fuel ratio on the leaner side than said first air-fuel ratio mode.

14. A control device for an internal-combustion engine as claimed in claim 13, wherein said mode selection means selects said second air-fuel ratio mode when the amount of intake air is increased and corrected by said intake air amount correction means upon returning from said fuel cut mode to said ordinary fuel control mode.

15. A control device for an internal-combustion engine as claimed in claim 14, wherein said mode selection means corrects the target air-fuel ratio in said second air-fuel ratio mode closer to the theoretical air-fuel ratio side than the air-fuel ratio previously set when increase and correction in the amount of intake air by said intake air amount correction means have not been completed.

16. A control device for an internal-combustion engine as claimed in claim 15, wherein said intake air amount correction means increases and corrects the amount of intake air when said second air-fuel ratio mode is selected, and reduces the corrected amount for the amount of intake air when the mode is switched from said second air-fuel ratio mode to said fuel cut mode while the amount of intake air is being increased and corrected.

17. A control device for an internal-combustion engine as claimed in claim 14, wherein when the deceleration rate of said internal-combustion engine or a vehicle mounted with said internal-combustion engine thereon is high, the target air-fuel ratio in said second air-fuel ratio mode is corrected closer to the theoretical air-fuel ratio side than the air-fuel ratio previously set.

18. A control device for an internal-combustion engine as claimed in claim 1, wherein said fuel injection device has a fuel injection valve for directly supplying fuel into the combustion chamber, wherein said ordinary fuel control mode includes at least intake stroke injection mode which is set such that the target air-fuel ratio becomes substantially equal to a theoretical air-fuel ratio, and compression stroke injection mode in which the target air-fuel ratio is set in such a manner that the target air-fuel ratio becomes an air-fuel ratio close to a leaner side than said intake stroke injection mode and fuel injection is performed mainly in the compression stroke, and wherein said mode selection means selects said compression stroke injection mode upon returning from said fuel cut mode to said ordinary fuel control mode.

19. A control device for an internal-combustion engine as claimed in claim 18, wherein said internal-combustion engine is provided with throttle valves provided in intake passages conductively connected to the combustion chamber, for being opened or closed correspondingly to an operating amount of an accelerator pedal, wherein said intake air amount correction means includes an air by-pass passage conductively connected to said intake passages on the upstream side and on the downstream side of said throttle valves, having the same passage cross-sectional area as said intake passages, and an air by-pass valve for controlling the passage cross-sectional area of said air by-pass passage, and wherein when said compression stroke injection mode is selected by said mode selection means, said intake air amount correction means controls said air by-pass valve to increase and correct the amount of intake air in correspondence with the operating condition, and when said fuel cut mode is selected, controls said air by-pass valve to reduce the correction amount for the amount of intake air.

20. A control device for an internal-combustion engine as claimed in claim 18, wherein said internal-combustion engine is provided with electrically-driven throttle valves provided in intake passages conductively connected to the combustion chamber, for being open-close controlled to obtain a target throttle valve opening to be set at least on the basis of the operating condition of the accelerator pedal, wherein said intake air amount correction means is constructed such that the amount of intake air is increased by setting to a larger opening than said target throttle valve opening to introduce such an amount of intake air as required for said compression stroke injection mode, and wherein when said compression stroke injection mode is selected by said mode selection means, said intake air amount correction means controls said electrically-driven throttle valves to increase and correct the amount of intake air in correspondence with the operating condition, and when said fuel cut mode is selected, controls said electrically-driven throttle valves to reduce the correction amount for the amount of intake air.

21. A control device for an internal-combustion engine as claimed in claim 18, wherein the deceleration rate of said internal-combustion engine or a vehicle mounted with said internal combustion engine thereon is high, the target air-fuel ratio in said compression stroke injection mode is corrected closer to the target air-fuel ratio side in said intake stroke injection mode than an air-fuel ratio previously set.

* * * * *